US005938013A

United States Patent [19]

Palumbo et al.

[11] Patent Number: 5,938,013

[45] Date of Patent: Aug. 17, 1999

[54] RESEALABLE PACK

[75] Inventors: Gianfranco Palumbo, Bad Homburg, Germany; Giovanni Carlucci, Chieti; Aldo Amicone, Montesilvano Pescara, both of Italy

[73] Assignee: The Procter & Gamble Co., Cincinnati, Ohio

[21] Appl. No.: 08/817,313

[22] PCT Filed: Oct. 5, 1995

[86] PCT No.: PCT/US95/13032

§ 371 Date: Jun. 23, 1997

§ 102(e) Date: Jun. 23, 1997

[87] PCT Pub. No.: WO96/11146

PCT Pub. Date: Apr. 18, 1996

[30] Foreign Application Priority Data

Oct. 7, 1994 [IT] Italy ..... TO94A0796

[51] Int. Cl.[6] ..... B65D 83/08

[52] U.S. Cl. ..... 206/210; 206/390; 206/812; 221/45; 383/66

[58] Field of Search ..... 206/210, 409, 206/410, 390, 494, 812; 221/45, 61, 63; 383/66, 208, 210, 211

[56] References Cited

U.S. PATENT DOCUMENTS

| | | | |
|---|---|---|---|
| 3,986,479 | 10/1976 | Bonk | 206/410 |
| 4,002,264 | 1/1977 | Marchesani | 206/409 |
| 4,101,026 | 7/1978 | Bonk | 206/410 |
| 4,181,218 | 1/1980 | Cox | 206/409 |
| 4,420,080 | 12/1983 | Nakamura | 206/449 |
| 4,462,507 | 7/1984 | Margulies | 206/210 |
| 4,552,269 | 11/1985 | Chang | 206/632 |
| 4,651,874 | 3/1987 | Nakamura | 206/205 |
| 4,718,738 | 1/1988 | Bell | 383/104 |
| 4,723,301 | 2/1988 | Chang | 383/211 |
| 4,840,270 | 6/1989 | Caputo et al. | 206/449 |
| 4,848,575 | 7/1989 | Nakamura et al. | 206/494 |
| 4,863,064 | 9/1989 | Dailey, III | 206/494 |
| 4,909,388 | 3/1990 | Watanabe | 206/210 |
| 5,531,325 | 7/1996 | Deflander et al. | 206/494 |

FOREIGN PATENT DOCUMENTS

| | | | |
|---|---|---|---|
| B 1-28 358/77 | 8/1977 | Australia | A45D 33/38 |
| WO 93/17933 | 9/1993 | WIPO | B65D 81/24 |

*Primary Examiner*—Jim Foster

*Attorney, Agent, or Firm*—Roddy M. Bullock; Larry L. Huston; Jacobus C. Rasser

[57] ABSTRACT

A resealable pack having a body portion formed substantially of flexible sheet material and defining an article-receiving cavity. The body portion comprises a first end defined by an end wall and tapers to a second end spaced apart from the first end. The body portion also comprises a face in which is defined a dispensing opening. A resealable sealing member is secured to the body portion and, in a closed position, covers the opening in sealing contact with the body portion around the periphery of the opening. A plurality of sheet-form articles is disposed within the cavity in the form of a flattened roll, with one end of the roll being capable of extending through the opening.

14 Claims, 7 Drawing Sheets

RESEALABLE PACK

This invention relates to a resealable pack. It is particularly intended for use in the packaging of wet wipes, but it is to be understood that the invention is also applicable to the packaging of other articles.

As is well known, wet wipes are articles in the form of small sheets which are impregnated with a skin- cleansing liquid and which are intended to be disposed of after a single use. Wet wipes are sometimes packaged individually, in which case the packaging is thrown away after it has been opened and the wet wipe removed therefrom. However it is also known to produce a pack containing a plurality of wet wipes. In that case, the pack must be provided with a resealable opening, since the skin-cleansing liquid with which the wipes are impregnated evaporates readily, and the wipes will therefore dry out unless the pack can be properly resealed after each wipe is removed.

Where a large number of wet wipes, say 40 to 200, is to be held in a pack, a rigid tub of cylindrical cross-section is conventionally used for this purpose. However, this is not always convenient from the point of view of the user, particularly where the pack is to be carried around in, for example, a handbag, and under such circumstances it would be preferable for the pack to be relatively flat and, preferably, at least slightly flexible. It is an object of the present invention to provide a pack which is a practical alternative to the rigid tubs conventionally used.

According to the present invention there is provided a pack having a body portion formed substantially of flexible sheet material and defining an article- receiving cavity, the body portion having a face in which is defined a dispensing opening; a resealable sealing member secured to the body portion and, in a closing position, covering the said opening and being in sealing contact with the body portion around the periphery of the said opening; and a plurality of sheet-form articles disposed within said cavity in the form of a flattenable roll, with one end of the roll being capable of extending through the said opening.

The body portion preferably has a thickness which is less than its length and is less than its width, and it is preferably in the general shape of a parallelepiped. The body portion is preferably made of a flexible, sheet plastics material, and the sealing member is likewise preferably made of a flexible, sheet plastics material.

An embodiment of the invention is shown diagrammatically in the accompanying drawings in which.

Figure 10A:
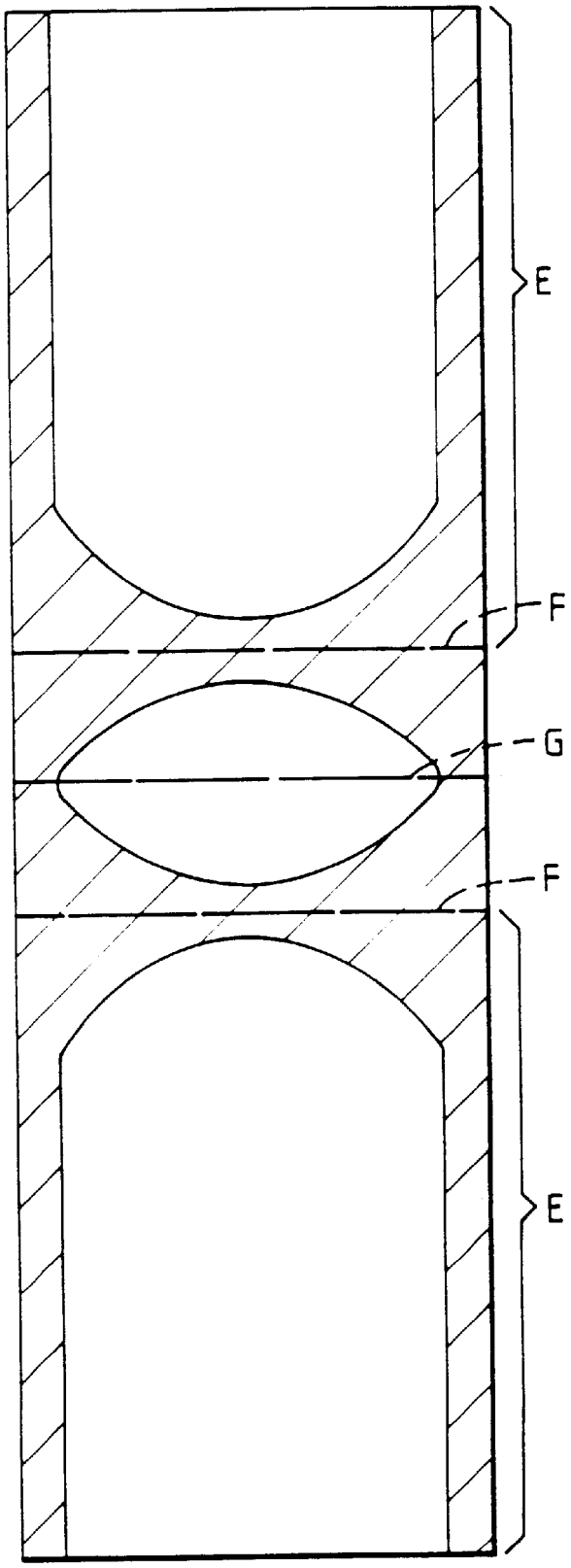
Figure 10B:
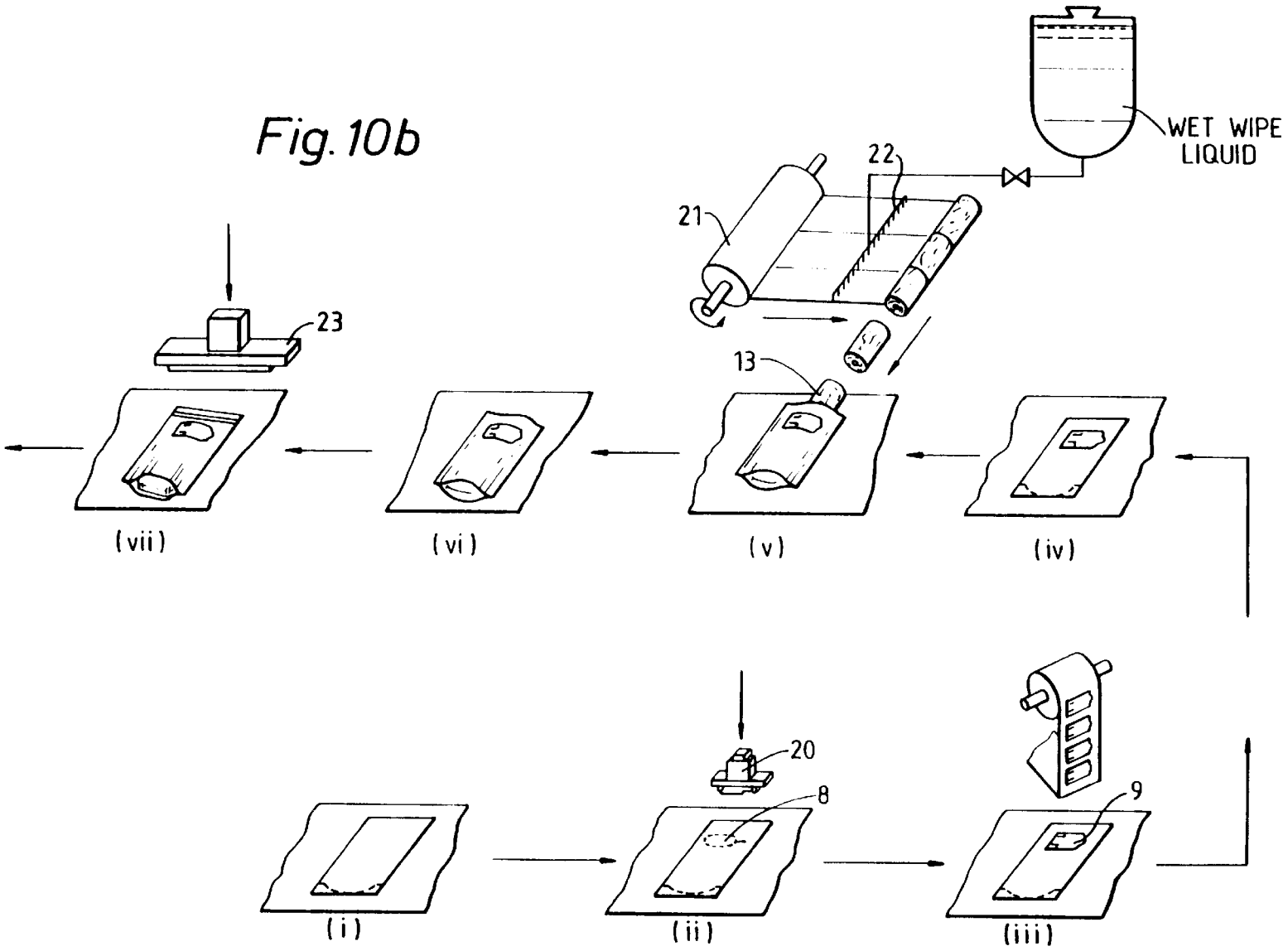

FIGS. 10*a* and 10*b* show diagrammatically a method of producing the pack according to the invention.

The illustrated pack is intended to hold from about 40 to about 200 wet wipes each approximately 230×160 mm, and each impregnated with a skin-cleansing liquid. The pack comprises a body portion 1 which is formed of a flexible sheet plastics material, for example a polyethylene film, a polypropylene film or a laminate consisting of, for example, polyethylene and polypropylene layers, optionally with a layer of paper between them. In the illustrated embodiment, the body portion is formed wholly of flexible sheet plastics material. Alternatively, however, the base of the body portion, that which is at the lower end as viewed in FIG. 1, can be formed of a rigid material, for example a rigid plastics material. The body portion is generally parallelepiped in form, though not precisely so. One end of the body portion is provided by an end wall 2, and the other end of the body portion is provided by a flat seam 3. The edges of the body portion are provided by flat seams 4 and 5. The body portion has major faces 6 and 7, and a dispensing opening 8 is provided in face 6.

Figure 6:
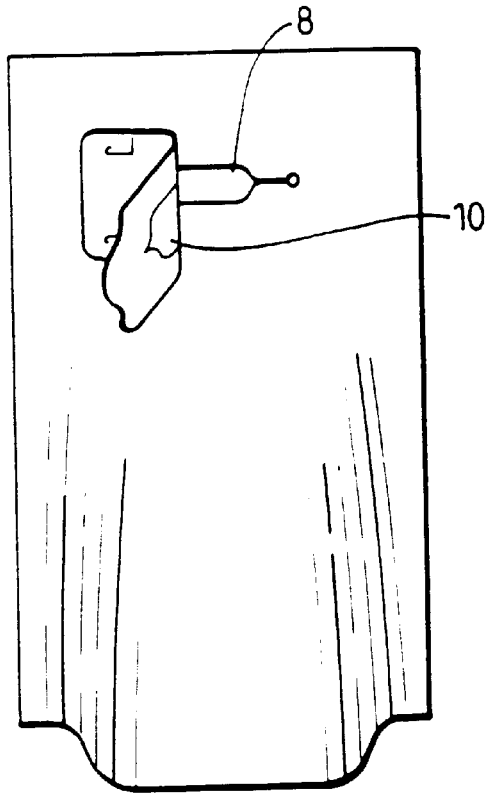
FIG. 6 is a view similar to FIG. 3, but with the closing member opened to a greater extent than in FIG. 5.
Figure 7:
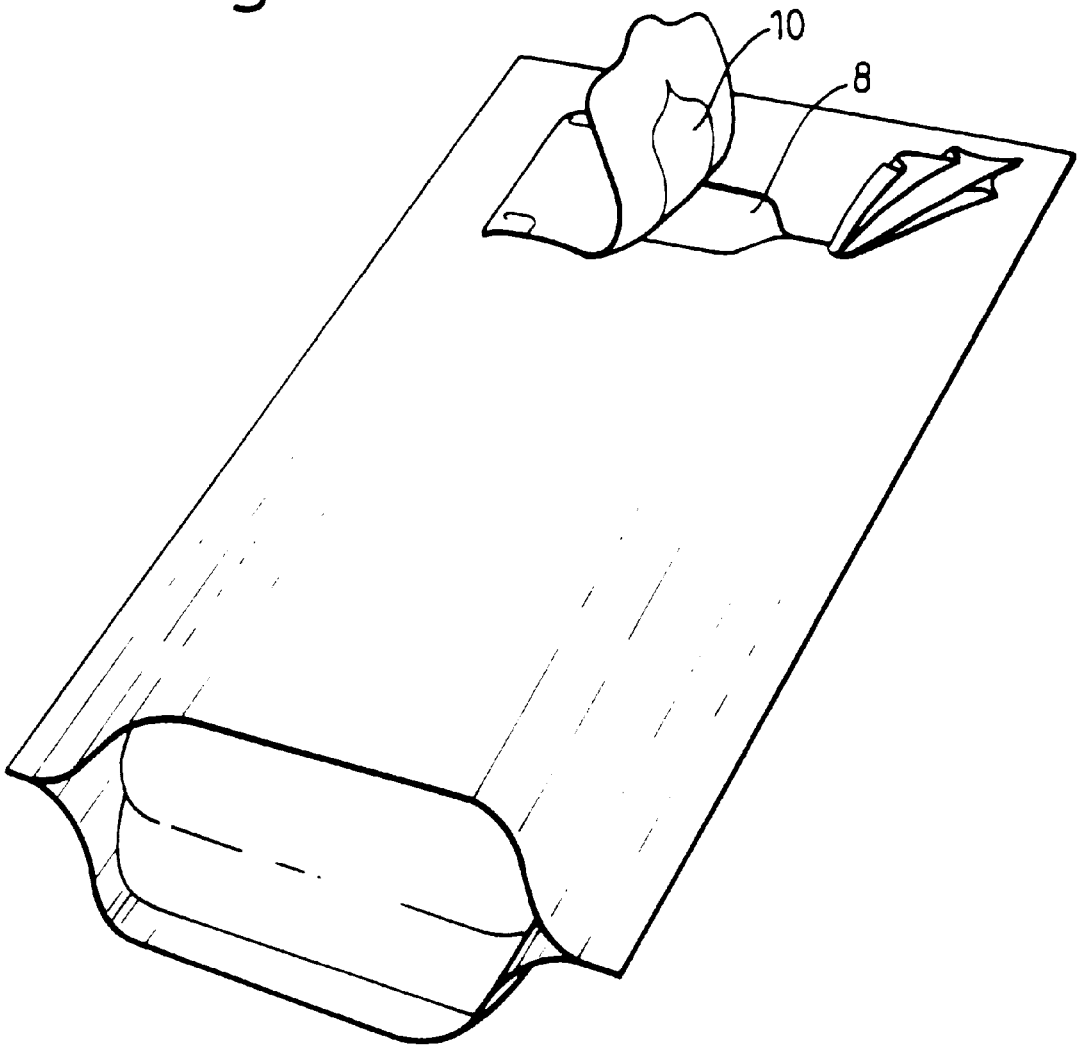
FIG. 7 is a perspective view, with the closing member in approximately the same position as in FIG. 6, and with the end of a wet wipe protruding from the dispensing opening.
Figure 8:
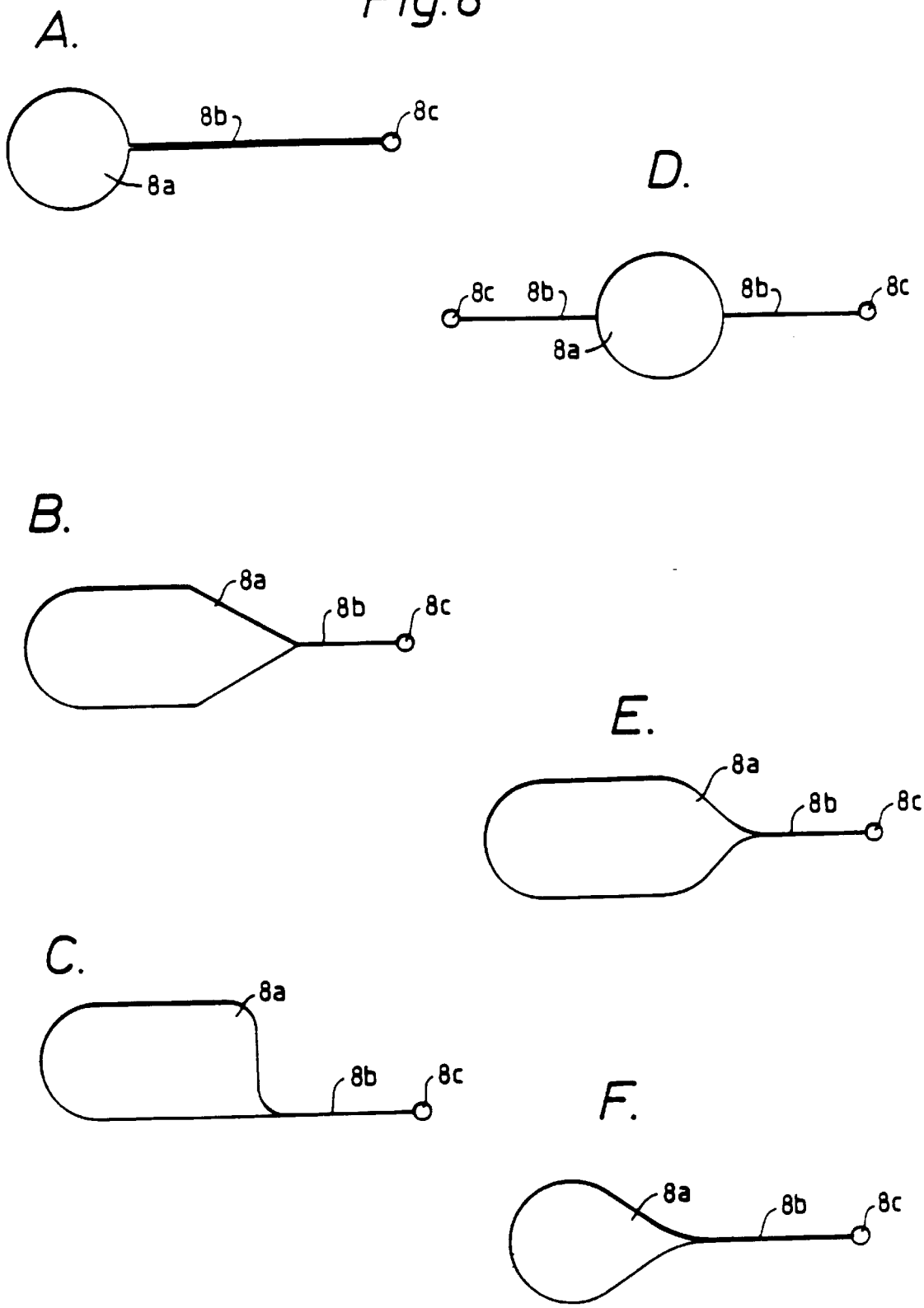
FIG. 8 shows, by way of example, six possible shapes for the dispensing opening.

The dispensing opening 8 can have a variety of forms, and some of these are illustrated by way of example in FIG. 8. Each of them comprises a main opening portion 8*a* connected by a slit 8*b* to a much smaller opening portion 8*c* or, in the case of example D of FIG. 8, by two slits 8*b* to two small opening portions 8*c*. Having two opening portions 8*c* in theory permits the user to pull wet wipes from the pack on either one of two directions. However, since the opening portion 8*c* further from the tab 9*a* may in practice be difficult to use, that opening portion may be omitted, whilst retaining the adjoining slit 8*b*. FIGS. 1 to 7 show the use of example E. The reason for using dispensing openings of the form shown in FIG. 8 will be apparent from the description given below of the use of the pack.

Figure 5:
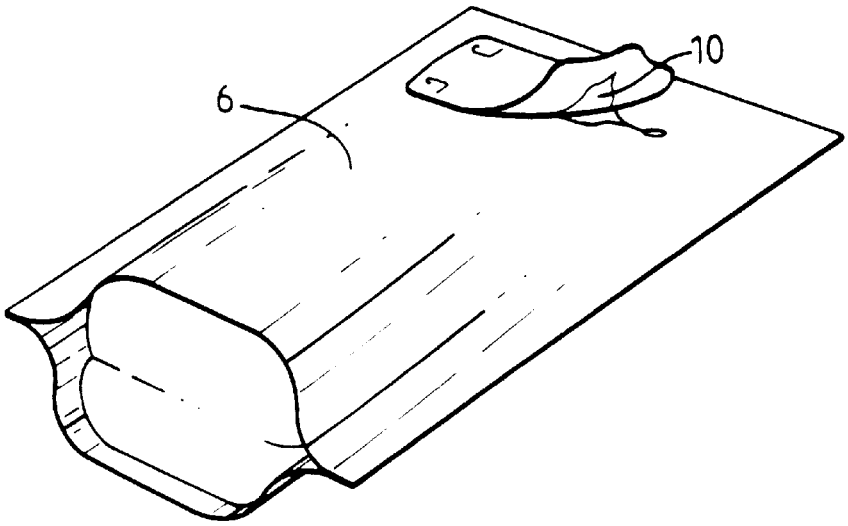
FIG. 5 is a view corresponding to FIG. 2, but with the closing member shown partially opened.

The dispensing opening 8 is covered by a sealing member 9 which, in its closing position, is sealed to the adjacent face 6 around the entire periphery of the dispensing opening. The sealing member 9 is made of a flexible sheet plastics material, for example a polypropylene film or a laminate of paper/polyethylene, paper/polypropylene or polyethylene/polypropylene. The member 9 is, however, provided with a tab 9*a* which is not sealed to the face 6, and which can be grasped by a user. The adhesive used to seal the member 9 to the face 6 is such that the sealing member 9 can be repeatedly unsealed and resealed, to expose and close the opening. For example an acrylic-based or rubber-based adhesive may be used. If desired, when the main opening portion 8*a* is formed in the face 6, the cut formed for this purpose may be deliberately made not completely continuous, with the result that the portion of the face 6 which would otherwise would have been severed therefrom remains attached to it at the end which, as viewed in FIG. 6, is at the left-hand end, by a small bridge of material. This portion is partly visible in FIGS. 5, 6 and 7, where it is denoted by reference numeral 10.

Figure 1:
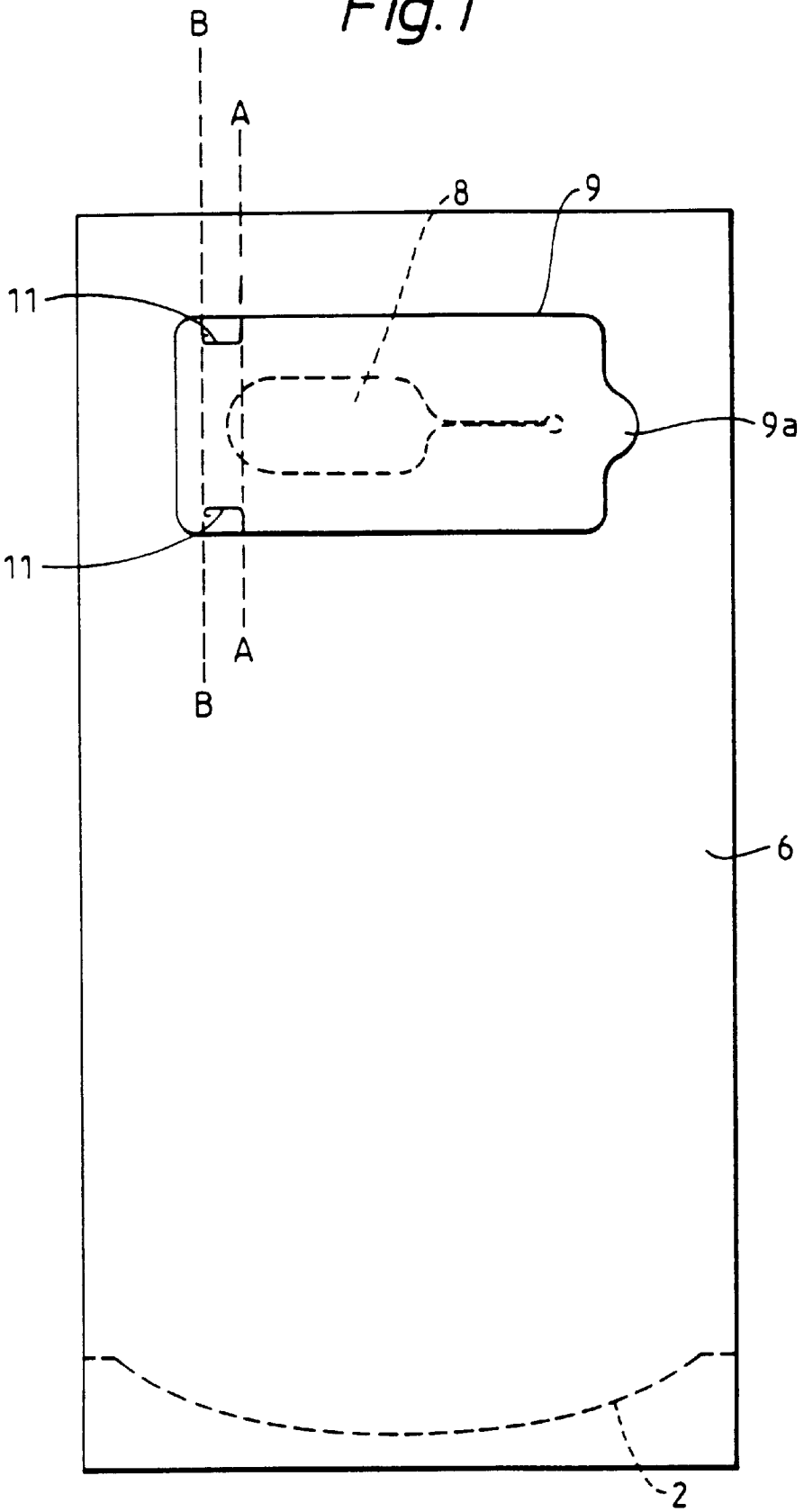
FIG. 1 is a plan view showing the side of the pack in which the dispensing opening is provided, the closing member being in its closed position.
Figure 2:
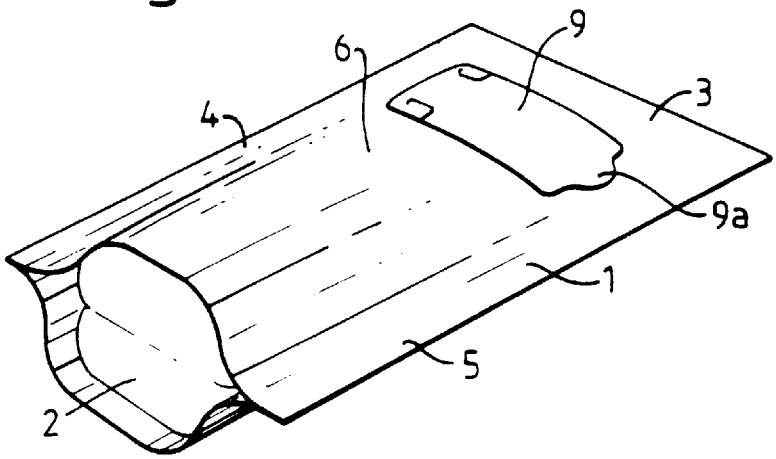
FIG. 2 is a perspective view of the pack.
Figure 3:
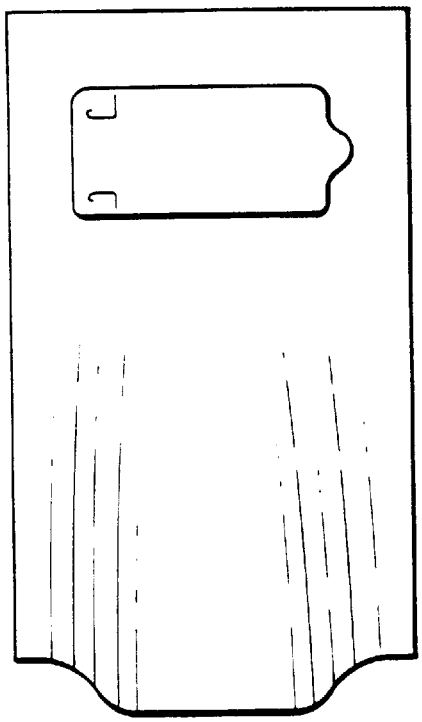
FIG. 3 is a plan view of the pack of FIG. 2, again in its closed position.
Figure 4:
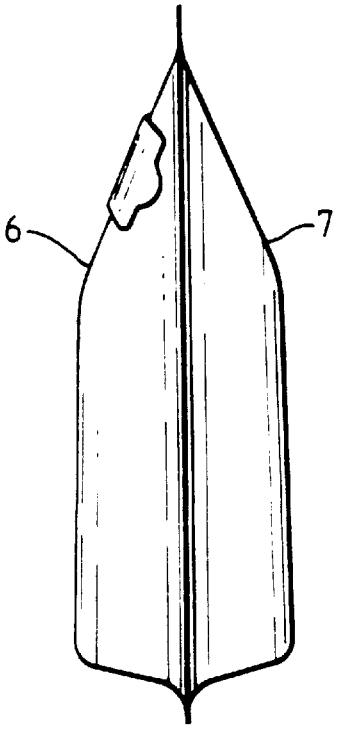
FIG. 4 is an edge view of the pack of FIG. 2, again in its closed position.

As can be seen most clearly in FIG. 1, at its left-hand end the sealing member 9 has two slits 11 formed therein. Each of these is in the form of an L-shaped slit which has a hook-shaped portion at one end and which extends to the edge of the sealing member 9 at its other end. The purpose of these slits will become apparent from the following description of the use of the pack.

Figure 9:
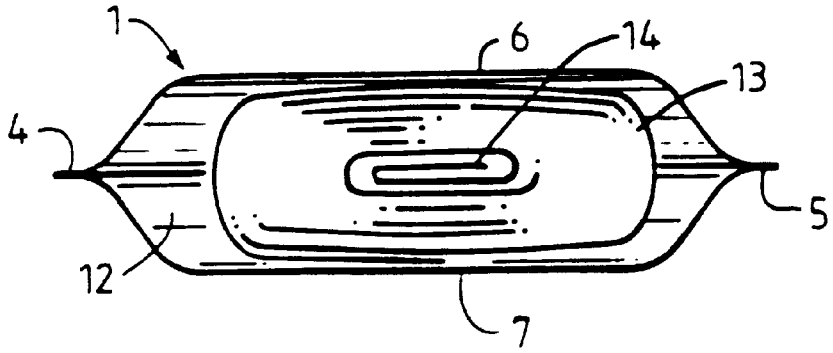
FIG. 9 is a cross-section through the pack.

As can be seen from FIG. 9, the body portion 1 defines a cavity 12 within which is received a roll 13 consisting of wet wipes joined end-to-end by perforated regions (not shown). The longitudinal axis of the roll extends generally parallel to the length of the said body portion. The roll has inner and outer free ends, and the inner free end 14 is pulled lengthwise of the roll, during manufacture of the pack, so that it extends slightly from the end of the rest of the roll, whilst not extending through the dispensing opening 8. When the roll 13 is loaded into the body portion during manufacture it is substantially cylindrical, but during use the flexibility of the body portion tends to permit the roll to become flattened, an effect which is advantageous since the pack is then less bulky. If the base of the body portion is rigid, it must not extend so far as to prevent flattening taking place.

The way in which the above-described pack is used is as follows. When the user desires to remove a wet wipe from the pack, he grasps the tab 9*a* and uses it to pull the sealing member 9 away from the dispensing opening 8. In so doing, the portion 10 remains adhered to the reverse side of the closing member, as can be seen in FIGS. 5, 6 and 7. A stage is reached at which the part of the closing member which remains adhered to the adjacent face 6 of the body portion is that to the left of the line A—A shown in FIG. 1. Continued pulling on the tab 9*a* has the effect that the portion of the member 9 between the slits 11 ceases to be adhered to the face 6, while the portions outwardly of the slits 11 remain adhered to the face 6. However, when the non-adhered portion reaches the line B—B, i.e. the left-hand of the slits 11, the user experiences a greatly increased resistance to continued peeling of the closing member 9 from the face 6. Indeed, further peeling is virtually impossible without tearing the sealing member. As a result, under all but exceptional circumstances the user will cease pulling on the tab at this point and the portion of the sealing member 9 to the left of line B—B will remain adhered to the face 6.

The user then grasps the exposed end of the roll of wet wipes and pulls on it at such an angle as to emerge through the opening portion 8*c*. Once a complete wet wipe has emerged, continued pulling, to which the opening portion 8*c* presents considerable resistance, causes the wet wipe grasped by the user to be separated from the rest of the roll along a perforation line, and leaves a portion of the next wet wipe extending therethrough. This can be seen in FIG. 7.

The user then tucks the exposed end portion of the next wet wipe back through the opening 8, where it is ready to be grasped the next time the pack is used, and reseals the sealing member 9 to the face 6.

The body portion of the pack according to the invention can be produced starting from a plastics sheet as indicated in FIG. 10*a*. Assume that a face which is visible in the drawing is that which is to provide the exterior of the body portion. The sheet is folded along the fold lines F so that the end portions E both move downwardly as considered with reference to the plane of the paper. The sheet is also folded along the fold line G by depressing the portion of the sheet between the lines F into the plane of the paper. As a result, the sheet assumes a configuration which, as viewed from the edge, has the appearance of a flattened "W". The adjacent portions of the sheet are then sealed together over the areas indicated by shading.

Figure 10*b* illustrates stages (i) to (vii) in going from the empty body portion to the final pack, as follows:

(i) The empty body portion.

(ii) A cutter 20 cuts out the opening 8.

(iii) A sealing member 9 is applied over the opening 8 from a strip to which a plurality of sealing members are removably adhered.

(iv) The body portion plus sealing member.

(v) A roll of wet wipes 13 is inserted in the body member, after a longer roll 21 thereof has been impregnated with wet wipe liquid by a spray device 22 and severed into a number of shorter rolls.

(vi) The body portion plus sealing member plus roll of wet wipes.

(vii) The open end of the body portion is closed by a sealing device 23.

It should be noted, however, that the order of steps (i) and (ii) can be reversed, and indeed preferably is, i.e. the openings 8 are cut in the material which is to form the body portion of the bag before the material is made into the body portion. This avoid any possibility of cutting through both sides of the bag. Optionally, the area where opening 8 is to be formed may have a reinforcing layer applied to the reverse side thereof, with the cutter cutting through both the bag materials and the reinforcing layer. This makes it possible to use thinner material as the bag material.

We claim:

1. A pack having a body portion formed substantially of flexible sheet material and defining an article-receiving cavity, the body portion comprising a first end defined by an end wall and tapering to a second end spaced apart from the first end, the body portion also comprising a face in which is defined a dispensing opening; a resealable sealing member secured to the body portion and, in a closing position, covering the opening and being in sealing contact with the body portion around the periphery of the opening; and a plurality of sheet-form articles disposed within the cavity in the form of a flattenable roll, with one end of the roll being capable of extending through the opening.

2. A pack according to claim 1, wherein the body portion is elongate and has a thickness which is less than its length and is less than its width.

3. A pack according to claim 2, wherein the roll is aligned with its longitudinal axis extending generally parallel to the length of the said body portion.

4. A pack according to claim 1, wherein the body portion is made of a plastics material.

5. A pack according to claim 1, wherein the sealing member is made of a flexible sheet plastics material.

6. A pack according to claim 1, wherein the roll is so arranged that said one end is the radially inner end thereof.

7. A pack according to claim 1, wherein the dispensing opening comprises a main opening portion and at least a smaller opening portion connected to the said main opening portion by a slit.

8. A pack according to claim 1, wherein the sealing member has a first end at which it is provided with a tab which is not sealed to the body portion and which can be grasped by a user.

9. A pack according to claim 8, wherein the sealing member has a second end, remote from said first end, at which it is provided with at least one slit therethrough which defines a sealing member portion which is adapted to remain in sealing contact with the body portion and prevent complete removal of the sealing member from the body portion.

10. A pack according to claim 1, wherein the roll is a roll of wet wipes.

11. A pack according to claim 10, wherein the wet wipes are connected to one another by perforated regions.

12. A pack according to claim 1, wherein the end wall comprises a rigid material.

13. A pack for dispensing removable sheet-form articles, the pack having a body portion formed substantially of flexible sheet material and defining an article-receiving cavity, the body portion comprising:

a first end defining an end wall and tapering to a second end spaced apart from the first end, thereby forming the article receiving cavity to have opposing, converging side faces;

a dispensing opening disposed on one of the converging side faces;

a resealable sealing member secured to the body portion and, in a closing position, covering the dispensing opening and being in sealing contact with the body portion around the periphery of the dispensing opening; and a plurality of sheet-form articles disposed within the cavity in the form of a flattenable roll, with one end of the roll being capable of being pulled through the dispensing opening, such that the flattenable roll is urged against the converging side faces when the one end of the roll is pulled through the dispensing opening.

14. A pack having a body portion formed substantially of flexible sheet material and defining an article-receiving cavity, the body portion comprising a face in which is defined a dispensing opening, the dispensing opening having a main opening portion and two smaller opening portions each connected to the main opening portion by a respective slit extending outwardly therefrom in opposite directions; a resealable sealing member secured to the body portion and, in a closing position, covering the opening and being in sealing contact with the body portion around the periphery of the opening; and a plurality of sheet-form articles disposed within the cavity in the form of a flattenable roll, with one end of the roll being capable of extending through the opening and either of the respective slits.

* * * * *